US006406110B1

(12) United States Patent
Ahne et al.

(10) Patent No.: US 6,406,110 B1
(45) Date of Patent: Jun. 18, 2002

(54) MECHANISM TO AUTOMATE ADJUSTMENT OF PRINTHEAD-TO-PRINT MEDIUM GAP SPACING ON AN IMAGING APPARATUS

(75) Inventors: Adam Jude Ahne, Lexington; Thomas Allen Bailey, Frankfort; William Michael Connors, Lexington, all of KY (US)

(73) Assignee: Lexmark International, Inc, Lexington, KY (US)

( * ) Notice: Subject to any disclaimer, the term of this patent is extended or adjusted under 35 U.S.C. 154(b) by 0 days.

(21) Appl. No.: 09/654,780

(22) Filed: Sep. 1, 2000

(51) Int. Cl.[7] ..... B41J 25/308
(52) U.S. Cl. ..... 347/8
(58) Field of Search ..... 347/8, 37; 400/55, 400/56, 59, 120.17, 120.16, 352, 354

(56) References Cited

U.S. PATENT DOCUMENTS

| | | | | |
|---|---|---|---|---|
| 4,652,153 | A | | 3/1987 | Kotsuzumi et al. |
| 4,927,277 | A | | 5/1990 | Niikawa |
| 4,990,004 | A | * | 2/1991 | Kawahara et al. ..... 400/56 |
| 5,131,765 | A | | 7/1992 | Bradley et al. |
| 5,135,316 | A | | 8/1992 | Kuramitsu et al. |
| 5,257,867 | A | | 11/1993 | Ito et al. |
| 5,456,544 | A | * | 10/1995 | Aoki et al. ..... 400/642 |
| 5,468,076 | A | | 11/1995 | Hirano et al. |
| 5,489,160 | A | * | 2/1996 | Patrick et al. ..... 400/642 |
| 5,608,430 | A | | 3/1997 | Jones et al. |
| 5,610,636 | A | | 3/1997 | Hanabusa et al. |
| 5,696,541 | A | | 12/1997 | Akahane et al. |
| 5,751,301 | A | | 5/1998 | Saikawa et al. |
| 5,815,171 | A | | 9/1998 | Brugue |
| 5,821,952 | A | | 10/1998 | Martenson et al. |
| 5,854,643 | A | | 12/1998 | Katsuyama |
| 5,872,579 | A | | 2/1999 | Handa et al. |
| 5,887,987 | A | | 3/1999 | Sawano |
| 5,975,666 | A | | 11/1999 | Kawaguchi |
| 5,980,132 | A | | 11/1999 | Kawai |
| 6,015,205 | A | | 1/2000 | Chambers et al. |

FOREIGN PATENT DOCUMENTS

| | | | |
|---|---|---|---|
| JP | 359138483 | * | 8/1984 |

* cited by examiner

*Primary Examiner*—John Barlow
*Assistant Examiner*—Ly T Tran
(74) *Attorney, Agent, or Firm*—Taylor & Aust, P.C.

(57) ABSTRACT

An imaging apparatus includes a first side frame and a second side frame, the second side frame being spaced apart from the first side frame. A guide rail extends between the first side frame and the second side frame. A guide rod having a first end, a second end and an axis is provided that extends between the first side frame and the second side frame, the guide rod being positioned to be substantially parallel to the guide rail. A printhead carrier that carries a printhead has a slotted portion for slideably engaging the guide rail and has a bearing for slideably engaging the guide rod. A first eccentric bushing assembly is provided for movably mounting the first end of the guide rod to the first side frame. A second eccentric bushing assembly is provided for movably mounting the second end of the guide rod to the second side frame. A gap spacing adjustment mechanism is coupled to at least one of the first eccentric bushing assembly and the second eccentric bushing assembly for effecting a change in position of the guide rod in a direction normal to the guide rod axis so as to adjust a spacing of a gap between the printhead and a print medium.

22 Claims, 6 Drawing Sheets

MECHANISM TO AUTOMATE ADJUSTMENT OF PRINTHEAD-TO-PRINT MEDIUM GAP SPACING ON AN IMAGING APPARATUS

BACKGROUND OF THE INVENTION

1. Field of the Invention

The present invention relates to an imaging apparatus, and, more particularly, to a mechanism for an imaging apparatus, such as an ink jet printer, that provides automated printhead-to-print medium gap spacing.

2. Description of the Related Art

In a typical ink jet printer having a reciprocating printhead, a printhead carriage carrying the printhead is supported by at least one carrier guide rod which is positioned substantially transverse to a print media path. As a sheet of print media is transported in an indexed manner under the printhead, the printhead is scanned in a reciprocating manner across the width of an image area on the sheet of print media, wherein the path of the reciprocating printhead defines a print zone. A platen is provided opposite to the printhead for contacting the non-printed side of the print media and, in part, defines the distance between the printhead and the sheet of print media.

One important parameter associated with an ink jet printer is the gap between the plane of the nozzle plate of the printhead and the plane of the print medium on which the ink expelled from the nozzle plate is deposited. As the gap becomes wider, the error in dot placement increases. The limits on the low end of the gap range is defined by the point at which the printhead actually contacts the media, thereby causing smearing of the freshly deposited ink. In addition, such contact with the print media can result in damage to the printhead such as, for example, by clogging the nozzles of the nozzle plate of the printhead. Thus, it is desirable in a high quality ink jet printer design to set the printhead-to-print medium gap to a optimum minimum value without permitting contact between the printhead and the print medium. However, while an optimum value may be obtained for a particular thickness of print media, any variation in thickness of the print medium, e.g., the difference between the thickness of 20 pound paper and the thickness of card stock or envelopes, results in variations in the printhead-to-print medium gap, which in turn adversely affects print quality.

What is needed in the art is a mechanism for an ink jet printer that provides automated printhead-to-print medium gap spacing.

SUMMARY OF THE INVENTION

The present invention provides a mechanism for an imaging apparatus, such as an ink jet printer, that provides automated printhead-to-print medium gap spacing.

The invention comprises, in one form thereof, an imaging apparatus having a printhead positioned above a print media support, wherein a print medium passes therebetween during printing. The imaging apparatus includes a first side frame and a second side frame, the second side frame being spaced apart from the first side frame. A guide rail extends between the first side frame and the second side frame. In addition, a guide rod having a first end, a second end and an axis is provided that extends between the first side frame and the second side frame, the guide rod being positioned to be substantially parallel to the guide rail. A printhead carrier is provided for carrying the printhead. The printhead carrier has a slotted portion for slideably engaging the guide rail and has a bearing for slideably engaging the guide rod. A first eccentric bushing assembly is provided for movably mounting the first end of the guide rod to the first side frame. A second eccentric bushing assembly is provided for movably mounting the second end of the guide rod to the second side frame. A gap spacing adjustment mechanism is coupled to at least one of the first eccentric bushing assembly and the second eccentric bushing assembly for effecting a change in position of the guide rod in a direction normal to the guide rod axis so as to adjust a gap spacing between the printhead and the print medium.

In one preferred form of the invention, the gap spacing adjustment mechanism provides a driven gear coupled to the first eccentric bushing. The gap spacing adjustment mechanism further includes a ratchet mechanism and a drive gear coupled to the ratchet mechanism. The ratchet mechanism includes an actuator for effecting selective rotation of the drive gear in a first rotational direction. The drive gear is positioned for engaging the driven gear to rotatably drive the driven gear to effect a change of position of the carrier guide rod in the direction normal to the guide rod axis so as to adjust the spacing of the printhead-to-print medium gap.

One advantage of the present invention is that the printhead-to-print medium gap spacing is easily adjusted for each thickness of media that can be accommodated by the imaging apparatus.

Another advantage is that the printhead-to-print medium gap spacing can be adjusted automatically with minimal user intervention.

Yet another advantage is that the printhead-to-print medium gap spacing can be optimized for each type of media accommodated by the imaging apparatus.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
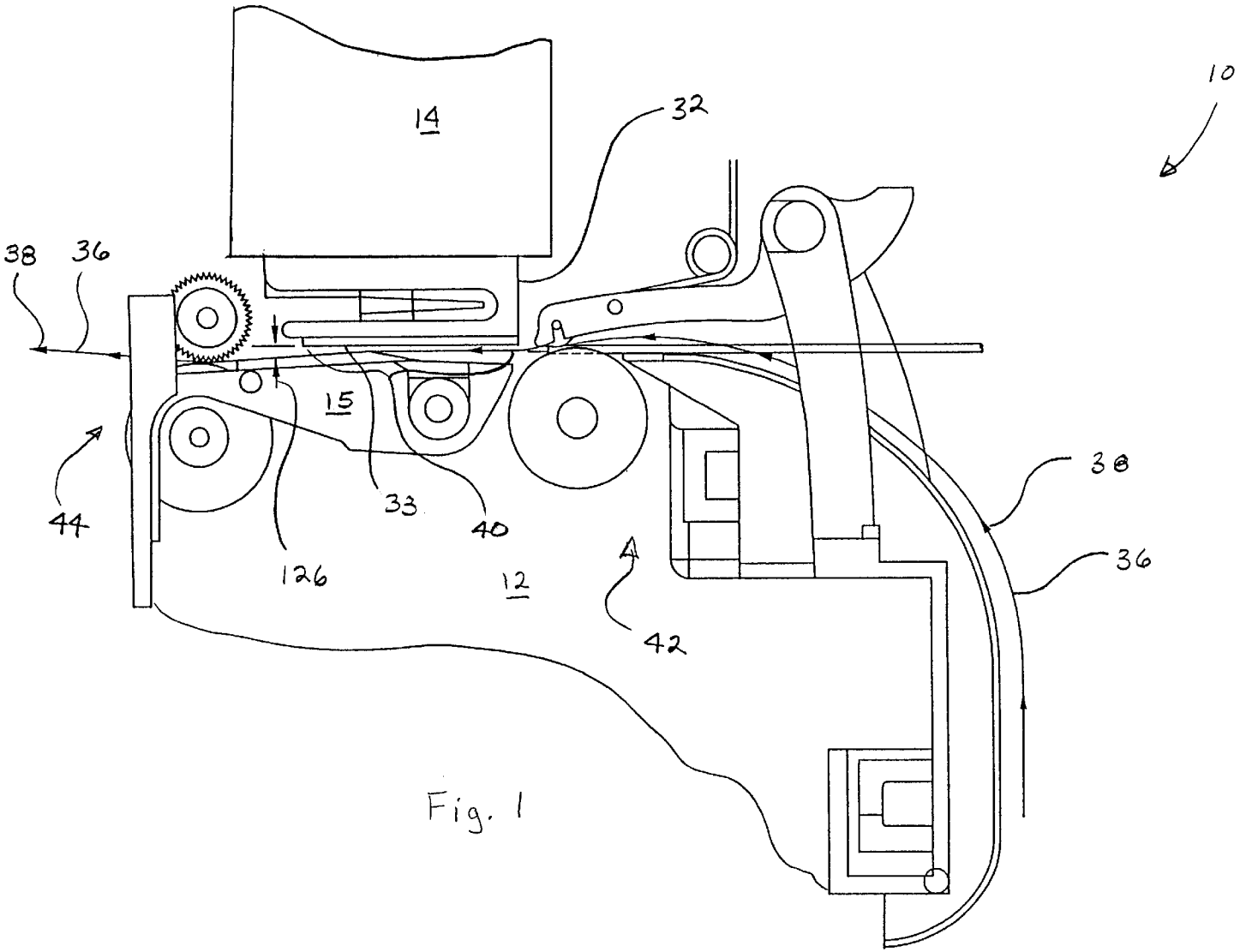
FIG. 1 is a schematic side view of an ink jet printer.
Figure 2:
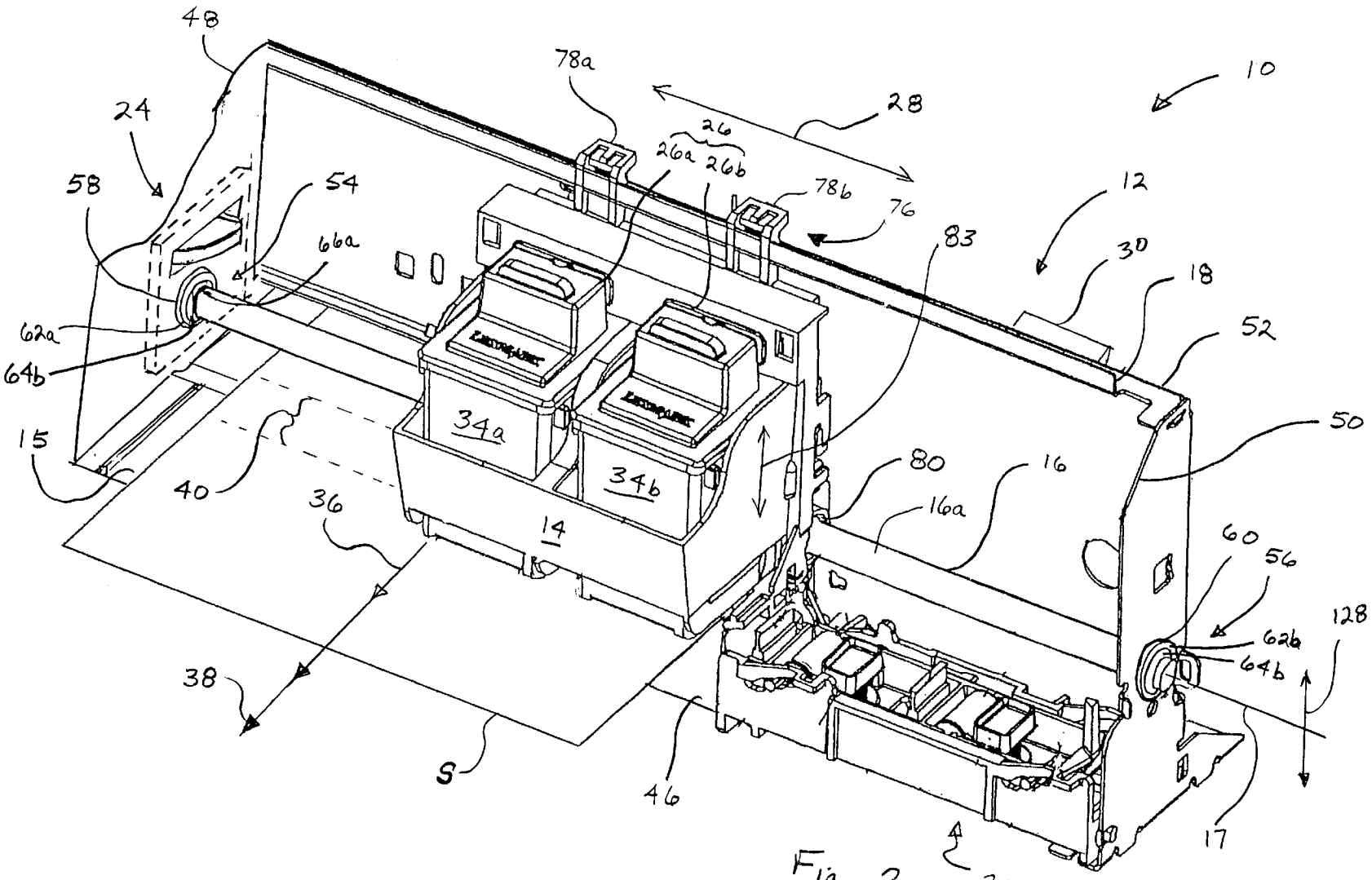
FIG. 2 is a partial perspective view of the ink jet printer of FIG. 1 embodying the present invention.

Referring now to the drawings and particularly to FIGS. 1 and 2, there is shown an ink jet printer 10 including a main frame 12, a printhead carrier 14, a platen 15, and as further shown in FIG. 2, a carrier guide rod 16, carrier guide rail 18, a maintenance station 22 and printhead-to-print medium gap spacing adjustment mechanism 24. Printhead carrier 14 is driven by a carriage drive system (not shown in detail) of a type known in the art, such as a belt coupled to a carrier drive motor 130 (see FIG. 7), to carry printhead cartridges 26*a,* 26*b* (collectively 26) in a reciprocating manner in a bi-directional path 28 defined by the orientation of guide rod 16 and carrier guide rail 18. Printhead cartridge 26*a* contains colored inks, such as magenta, yellow and cyan, and printhead cartridge 26*b* contains black ink. The movement of printhead carrier 14 and the ejection of ink from printhead cartridges 26 are controlled by a printer controller 30, including a microprocessor and associated memory, of a type known in the art.

Referring to FIG. 1, each of printhead cartridges 26*a,* 26*b* includes a printhead 32 (only one shown) having a surface including a nozzle plate 33 containing a plurality of nozzles for controllably expelling ink droplets from a respective one of ink reservoir 34*a,* 34*b* onto a sheet of print media S (see FIG. 2). Although each of print cartridges 26 is shown as forming an integral unit, those skilled in the art will recognize that ink reservoirs 34*a,* 34*b* may be mounted remotely from the printheads 32 and connected to the respective printhead via a conduit. In such a configuration, printhead carrier 14 would not need to carry the ink reservoir.

During a printing operation, the sheet S of print media is transported in a manner known in the art along a media path 36 in a media feed direction, as depicted by arrows 38, past printhead 32. The bi-directional path 28 traveled by printhead 32 defines a print zone 40 (as graphically depicted between dashed lines in FIG. 2). Also shown in FIG. 1 is a feed roller assembly 42 for indexing the sheet S past printhead 32, and an exit roller assembly 44 for advancing the printed sheet S out of ink jet printer 10.

During a printhead maintenance operation, printheads 32 are positioned above printhead maintenance station 22. The functions associated with printhead maintenance as performed by printhead maintenance station 22, e.g., wiping, spitting and capping of ink jet printheads, are well know in the art, and will not be discussed further here.

As shown in FIG. 2, printer frame 12 includes a base 46, a first side frame 48, a second side frame 50 and a rear side frame 52. Each of side frames 48, 50 and 52 are attached to base 46, wherein first side frame 48 is spaced apart from second side frame 50, and rear side frame 52 is positioned to extend between and is attached to first side frame 48 and second side frame 50. As shown, carrier guide rail 18 is formed as an integral portion of rear side frame 52. However, those skilled in the art will recognize that carrier guide rail 18 may be formed as a separate unit. In the embodiment shown, each of carrier guide rod 16 and carrier guide rail 18 extend between first and second side frames 48, 50 and are positioned substantially above and transverse to media path 36. More particularly, carrier guide rod 16 and carrier guide rail 18 are located upstream from print zone 40, wherein the term upstream is used in relation to media feed direction 38.

Preferably, carrier guide rod 16 is made of steel and has a diameter across axis 17 of about 8 millimeters. Also preferably, carrier guide rail 18 is made of metal, such as aluminum or steel.

Figures 3, 4:
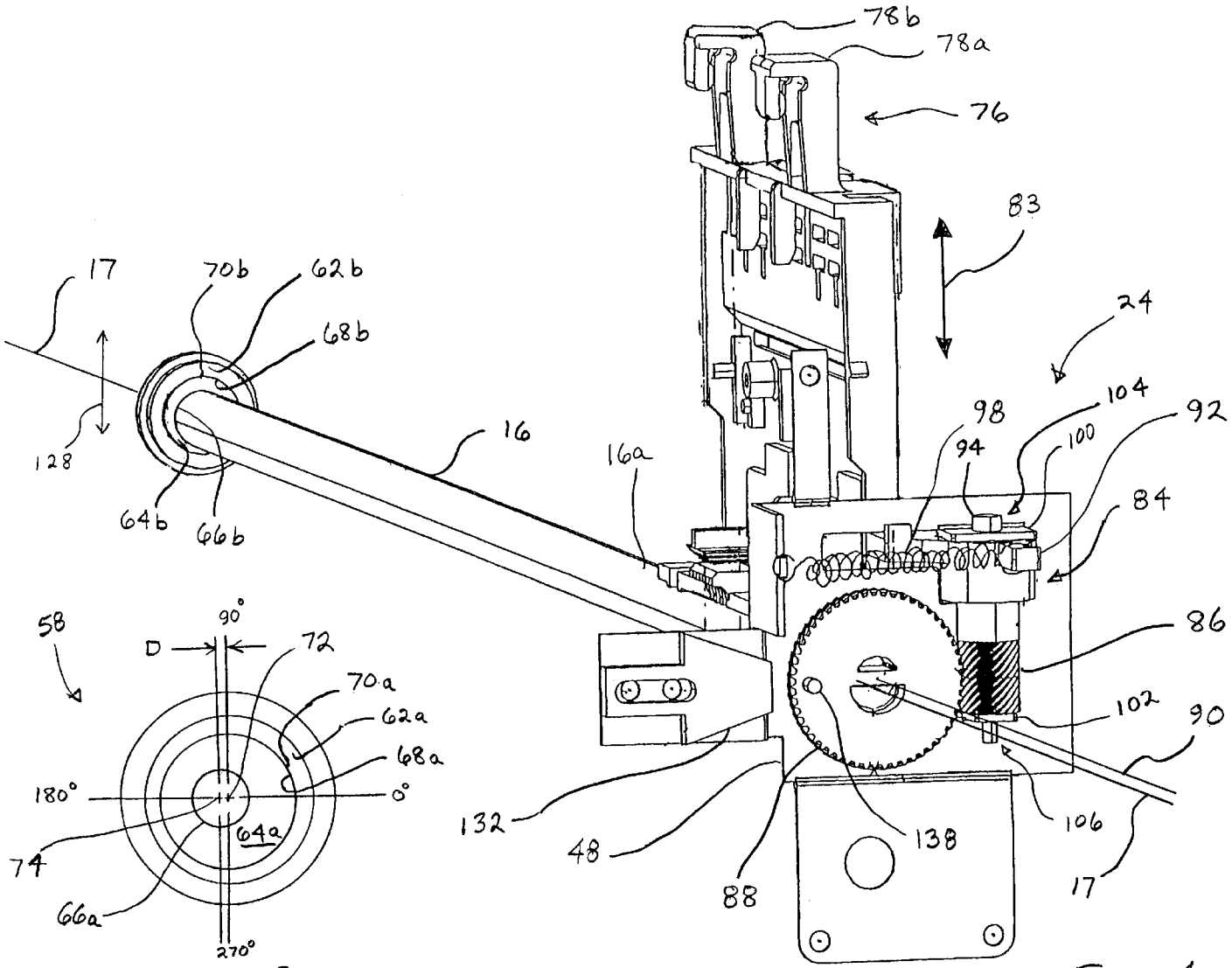
FIG. 3 is a side view of an eccentric bushing assembly used in connection with the present invention.
FIG. 4 is a partial perspective view of the left side of the ink jet printer, as oriented in FIG. 2, illustrating a gap spacing adjustment mechanism of the invention.

Carrier guide rod 16 has a first end 54 and a second end 56, wherein first end 54 is movably mounted to first side frame 48 by a first eccentric bushing assembly 58 and second end 56 is moveably mounted to second side frame 50 by a second eccentric bushing assembly 60. As shown collectively in FIGS. 2, 3 and 4, each of first eccentric bushing assembly 58 and second eccentric bushing assembly 60 includes (as most clearly depicted in FIGS. 3 and 4) a stationary portion 62*a,* 62*b,* respectively, which is attached to a respective one of first side frame 48 and second side frame 50, and a rotatable portion 64*a,* 64*b,* respectively, attached to a respective one of first end 54 of guide rod 16 and second end 56 of said guide rod 16 via a corresponding cylindrical hole 66*a,* 66*b,* respectively. Each stationary portion 62*a,* 62*b* includes an inner cylindrical surface 68*a,* 68*b,* respectively. Each rotatable portion 64*a,* 64*b* includes an outer cylindrical surface 70*a,* 70*b,* respectively, having a periphery located a first distance from a corresponding first centroid 72, as depicted in FIG. 3. Outer cylindrical surface 70*a* of rotatable portion 64*a* is positioned for rotatable engagement within inner cylindrical surface 68*a* of stationary portion 62*a.* Likewise, outer cylindrical surface 70*b* of rotatable portion 64*b* is positioned for rotatable engagement within inner cylindrical surface 68*b* of stationary portion 62*b.* Each of cylindrical holes 66*a,* 66*b* formed in rotatable portions 64*a,* 64*b,* respectively, has a radius extending from a corresponding second centroid 74 (see FIG. 3) which is offset a distance D from a location of first centroid 72. Preferably, holes 66*a,* 66*b* are sized for receiving guide rod 16 in a snug fit. Also, preferably, guide rod 16 is attached to rotatable portions 64*a,* 64*b* in a manner, such as by welding or keying guide rod 16 to rotatable portions 64*a,* 64*b,* to form a unitary structure so as to prevent independent movement therebetween.

Referring to FIGS. 1, 2 and 4, printhead carrier 14 has an upper slotted portion 76, which forms two slotted receptacles 78*a,* 78*b,* and a bearing 80 (as shown in FIG. 2) having a cylindrical hole 80*a* forming an inner bearing surface which contacts outer surface 16*a* of guide rod 16. Upper slotted portion 76 is designed to slideably engage guide rail 18 while permitting generally vertical movement of printhead carrier 14 in the directions depicted by arrowed line 83, i.e., in directions substantially normal to the portion of media path 36 in print zone 40, and normal to axis 17 of carrier guide rod 16.

Figure 5:
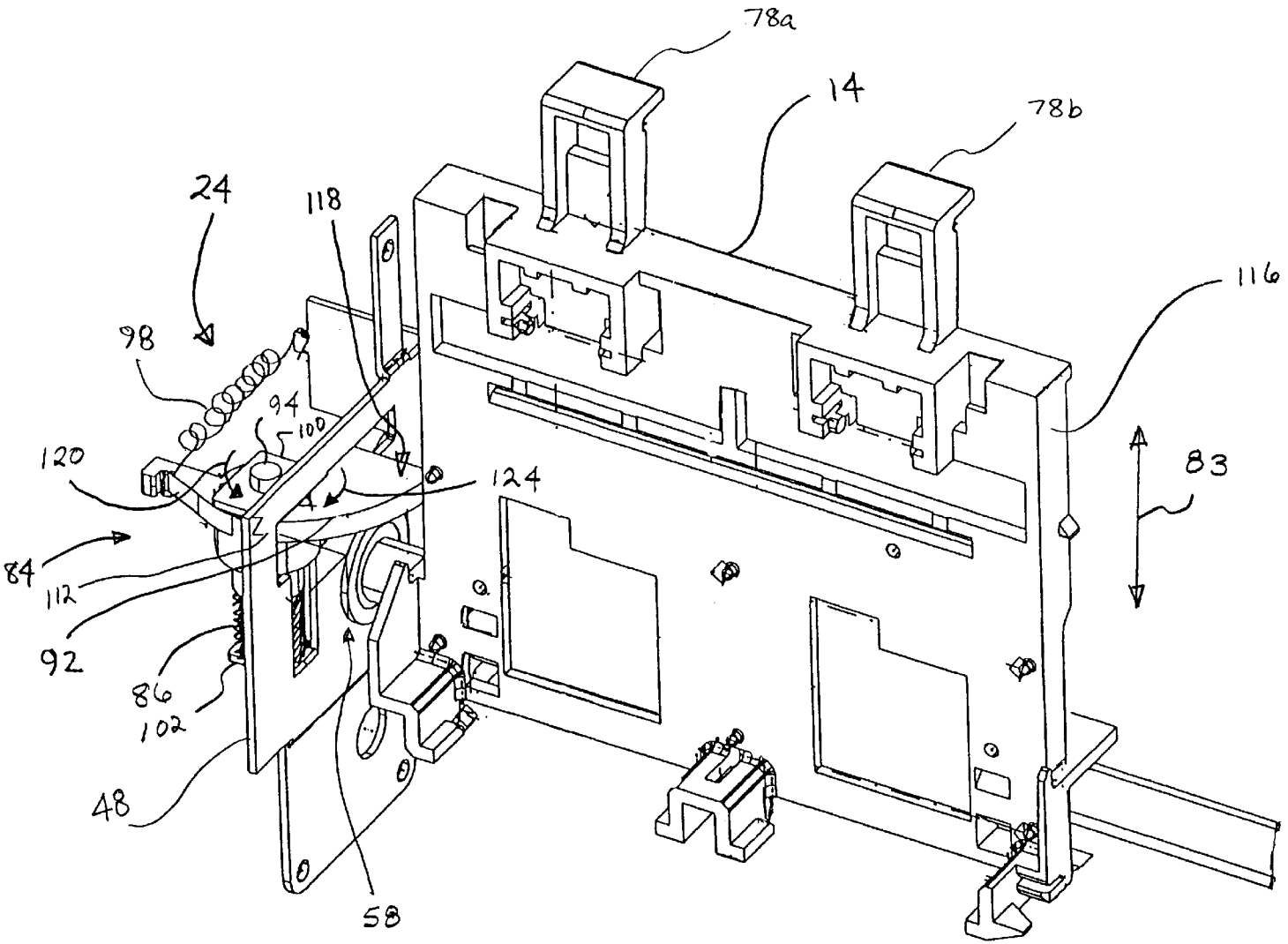
FIG. 5 is a partial perspective view illustrating the gap spacing adjustment mechanism of FIG. 4 as viewed from the left side of the ink jet printer as oriented in FIG. 2.

Referring now to FIGS. 2, 4 and 5, gap spacing adjustment mechanism 24 includes a ratchet mechanism 84, a drive gear 86 and a driven gear 88. Drive gear 86 is rotatably coupled to ratchet mechanism 84 to be rotatably driven thereby. Drive gear 86 is positioned for engaging driven gear 88 to rotatably drive driven gear 88. Driven gear 88 is attached to rotatable portion 64*a* of first eccentric bushing assembly 58 for co-axial rotation about an axis 90 which passes through centroid 72 of each of rotatable portions 64*a,* 64*b.*

Figure 6:
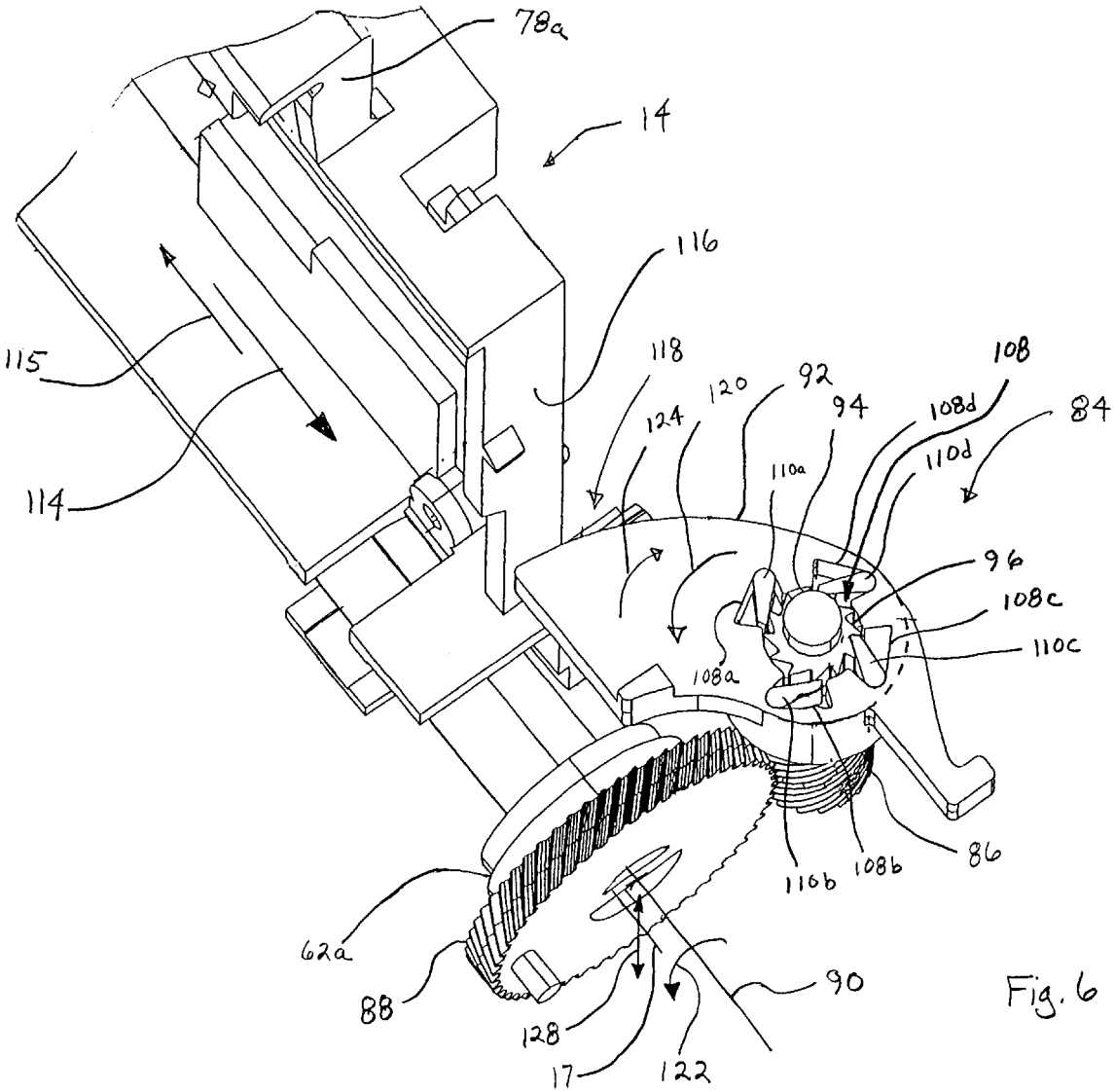
FIG. 6 is a top perspective view of the gap spacing adjustment mechanism of the invention.

Referring now to FIGS. 4, 5 and 6, ratchet mechanism 84 includes an actuator arm 92, a shaft 94, a ratchet gear 96 and a spring 98. Each of drive gear 86 and ratchet gear 96 has a hole through which shaft 94 is received and attached. Extending Referring now to FIGS. 4, 5 and 6, ratchet mechanism 84 includes an actuator arm 92, a shaft 94, a ratchet gear 96 and a spring 98. Each of drive gear 86 and ratchet gear 96 has a hole through which shaft 94 is received and attached. Extending outwardly from first side frame 48 is a first mounting tab 100 and a second mounting tab 102. Mounting tabs 100, 102 each include a hole for rotatably mounting shaft 94 at the shaft's first and second ends 104, 106, respectively. The shaft assembly formed by shaft 94, drive gear 86 and ratchet gear 96 is oriented such drive gear 86 and ratchet gear 96 are positioned between mounting tabs 100, 102.

Referring to FIG. 6, actuator arm 92 is mounted for pivotal movement with respect to shaft 94 and ratchet gear 96. Actuator arm 92 includes an opening 108 forming four elongated recessed regions 108*a*, 108*b*, 108*c*, 108*d*. Ratchet gear 96 is received in opening 108. Four pivot dogs 110*a*, 110*b*, 110*c*, 110*d* are positioned between corresponding recessed regions 108*a*, 108*b*, 108*c*, 108*d* and the saw tooth shaped teeth of ratchet gear 96, and are spring biased such that the tip ends of pivot dogs 110*a*, 110*b*, 110*c*, 110*d* are in contact with the teeth of ratchet gear 96. Actuator arm 92 is biased by spring 98 against a stop 112 (see FIG. 5).

Referring again to FIG. 6, as printhead carrier 14 is moved in the direction of arrow 114, a side portion 116 of printhead carrier 14 comes into contact with engagement end 118 of actuator arm 92. As printhead carrier 14 further moves in the direction depicted by arrow 114, at least one of pivot dogs 110*a*, 110*b*, 110*c*, 110*d* engage a region between two adjacent teeth of ratchet gear 96 to effect a rotation of shaft 94 in the direction depicted by arrow 120. The rotation of shaft 94 in turn produces a corresponding rotation of drive gear 86, which in turn produces a rotation of driven gear 88 in the direction depicted by arrow 122.

The amount of incremental angular rotation of driven gear 88 is dependent on such factors as the length of the stroke of actuator arm 92 and the gear ratio formed by drive gear 86 and driven gear 88. In the present embodiment, for example, the combination of such factors may effect an angular rotation of driven gear 88 by an amount of 12 degrees per full engagement of side portion 116 of printhead carrier 14 with engagement end 118 of actuator arm 92.

The rotation of driven gear 88 in turn produces a corresponding rotation of rotatable portion 64*a* of eccentric bushing assembly 58, and a corresponding rotation of rotatable portion 64*b* of eccentric bushing assembly 60 via the eccentric motion of carrier guide rod 16. A vertical component in the eccentric motion of carrier guide rod 16 will effect movement of printhead carrier 14 in a vertical direction which in turn causes printhead carrier 14 to move in one of the generally vertical directions depicted by arrowed line 83. Whether the vertical component of the movement of the position of carrier guide rod 16, and in turn printhead carrier 14, is upward or downward will depend on rotational position of the offset axis 17 of carrier guide rod 16 with respect to the rotational axis 90.

When carrier 14 is moved in the direction opposite to that depicted by arrow 114, i.e., in the direction depicted by arrow 115, the biasing force exerted by spring 98 causes actuator arm 92 to pivot about shaft 94 in the direction depicted by arrow 124. However, since pivot dogs 110*a*, 110*b*, 110*c*, 110*d* pass over the saw tooth shaped teeth of ratchet gear 96, no rotation of shaft 94 occurs. This pivot of actuator arm 92 in the direction depicted by arrow 124 essentially resets actuator arm 92 back to a position to enable a subsequent incremental rotation of driven gear 88 upon a subsequent engagement of side portion 116 of printhead carrier 14 with engagement end 118 of actuator arm 92.

Through repeated cycles of engagement and disengagement of side portion 116 of printhead carrier 14 with engagement end 118 of actuator arm 92, driven gear 88 is incrementally rotated, which translates into the incremental movement of carrier guide rod 16 in a direction having a directional component normal to axis 17 as depicted by arrowed line 128 (see FIG. 4), which in turn translates into a substantially vertical movement of printhead carrier 14 in one of the directions depicted by arrowed line 83. Referring again to FIG. 1, since the nozzle plate 33 of printhead 32 is held in fixed relation with printhead carrier 14, then the incremental vertical movement of printhead carrier 14 translates into an incremental vertical movement of printhead nozzle plate 33 in relation to platen 15 in print zone 40 to change a distance of the printhead-to-platen gap 126 in print zone 40. This change in gap 126 in turn translates to a change in the printhead-to-print medium gap when a print medium is transported between printhead 32 and platen 15 during printing.

Figure 7:
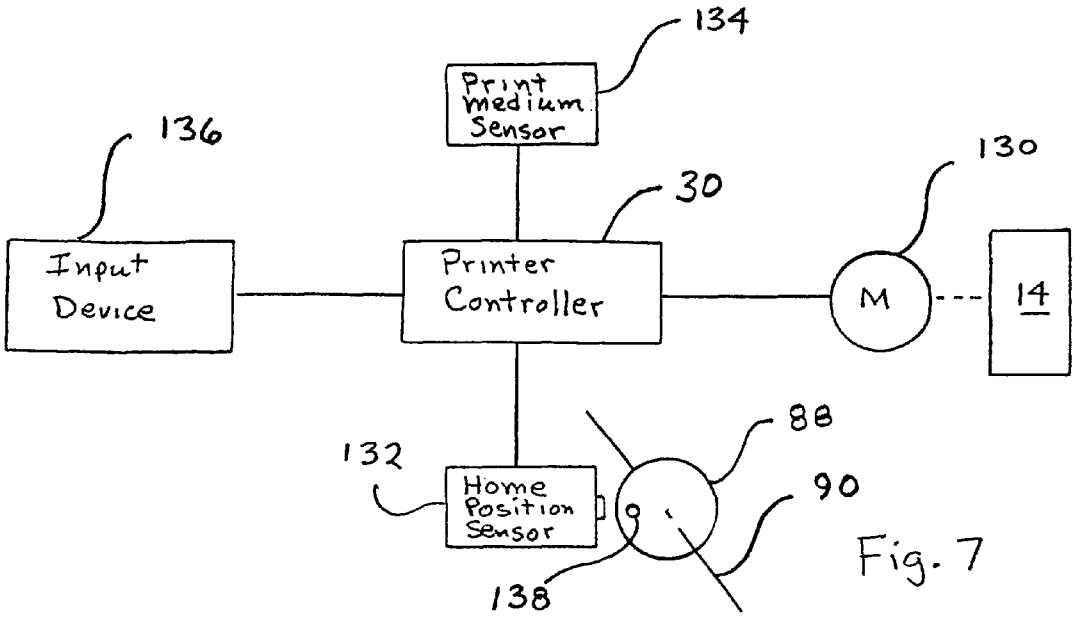
FIG. 7 is a block diagram of the control circuitry of the present invention.

Referring now to FIG. 7, printer controller 30 is shown electrically coupled to carrier drive motor 130, a home position sensor 132, a print medium sensor 134 and a print medium input device 136. Carrier drive motor 130 is coupled to printhead carrier 14 via a belt (not shown) to effect reciprocating movement of printhead carrier 14 in each of the directions depicted by arrows 114 and 115 (see FIG. 6). Home position sensor 132 (see also FIG. 4) is positioned to detect the presence or absence of a home indicator pin 138 extending outwardly from driven gear 88.

Since home indicator pin 138 is mounted on driven gear 88, the angular position of indicator pin 138 directly relates to the angular position of driven gear 88 and to the vertical position of carrier guide rod 16. For example, the location of home indicator pin 138 on driven gear 88 may be selected, for example, so that home position sensor 132 detects the presence of home indicator pin 138 when axis 17 of carrier guide rod 16 is located at 180 degrees, as shown in FIG. 3. From the home position, printer controller 30 keeps track of the number of incremental movements which has been effected by gap spacing adjustment mechanism 24, and thus, can determine both the angular position of home indicator 138 and the vertical position of carrier guide rod 16 normal to axis 17. The determination of the vertical position carrier guide rod 16 is preferably preformed by correlating the angular position of driven gear 88 (and in turn home indicator pin 138) to a particular gap spacing between printhead(s) 32 and the print medium.

As is apparent from the drawings and discussion above, home indicator pin 138 returns to the home position after every 360 degrees on rotation of driven gear 88. In addition, carrier guide rod 16 is moved from a position associated with a minimum printhead-to-platen gap to a position associated with a maximum printhead-to-platen gap at 180 degrees of rotation of driven gear 88. Thus, assuming that each engagement-disengagement cycle of carrier 14 with actuator arm 92 results in a incremental rotation of driven gear 88 by 12 degrees, 15 selectable incremental gap positions exist between the minimum printhead-to-platen gap and the maximum printhead-to-platen gap.

Print medium sensor 134 provides a signal to printer controller 30 which represents a characteristic of the print medium which can be correlated to the thickness of a print medium under consideration, whereas print medium input device 136 provides a signal from which printer controller 30 derives an assumed thickness of a print medium.

For example, sensor 134 may provide a signal to printer controller 30 indicative of an actual measured thickness of the print medium. Alternatively, sensor 134 may provide a signal representing a particular reflectance of the print medium, in which case printer controller 30 responds by accessing a look-up table which correlates a particular reflectance to a particular medium thickness. In any event, sensor 134 provides an input representative of a measured characteristic of the print medium to printer controller 30, which is converted by printer controller 30 into a print medium thickness value.

In contrast, and as an alternative to or in addition to using sensor 134, a signal representing a characteristic associated with an assumed thickness of a print medium can be supplied to printer controller 30 by input device 136. Input device 136 may be, for example, a keypad through which a thickness input is supplied by the user, a paper size input supplied by the user, or a paper size detector which provides an indication of a media type set in a media tray (not shown). In any event, printer controller 30 manipulates the input as necessary to generate an assumed print medium thickness value.

Figure 8:
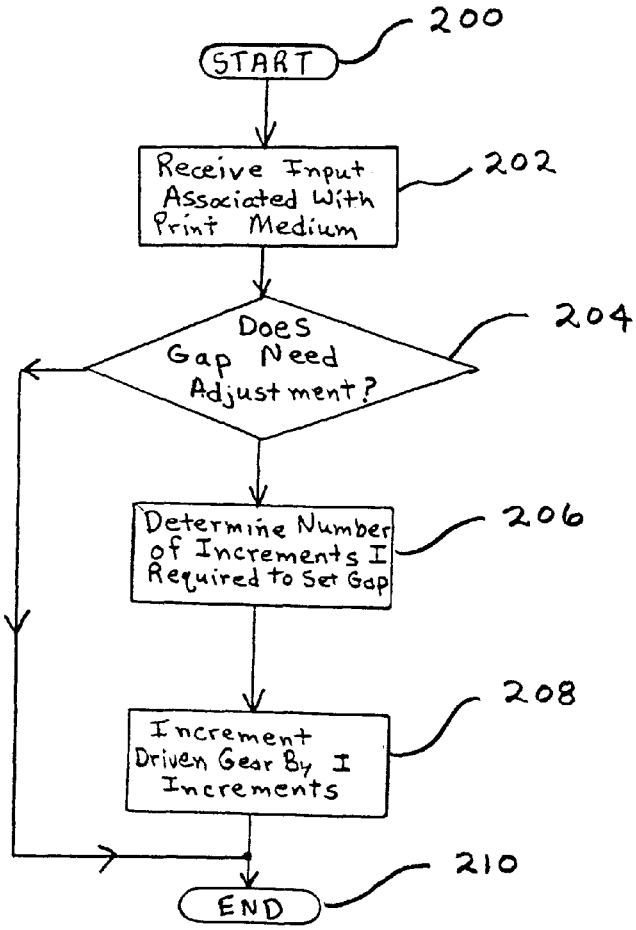
FIG. 8 is a flowchart illustrating a process of the present invention.

FIG. 8 provides a flowchart to illustrate the process of printhead-to-print medium gap spacing adjustment according to the present invention. At start step 200, printer controller 30 knows the spacing of the present gap 126 between printhead 32 and platen 15 based on the current position of home indicator pin 138. At step 202, printer controller 30 receives an input signal associated with a print medium from at least one of print medium sensor 134 and print medium input device 136, which in turn printer controller 30 converts into a print medium thickness value V. Based on the present position of home indicator pin 138 and the print medium thickness value V, printer controller 30 determines at step 204 whether the printhead-to-print medium gap needs adjustment. If the determination is NO, then the process is concluded and the process flow proceeds to end block 210. If the determination is YES, then printer controller 30 determines the number of angular increments I of rotation of driven gear 88 necessary (in view of the current position of home indicator pin 138) to position printhead(s) 32 at the desired position to effect the desired printhead-to-print medium gap. Once the number of angular increments I has been determined, then printer controller controls carrier drive motor 130 to cyclically move side portion 116 of carrier 14 into engagement with actuator arm 92 and out of engagement with actuator arm 92 a number of cycles corresponding to I. Through the cycle(s) of engagement and disengagement of side portion 116 of printhead carrier 14 with engagement end 118 of actuator arm 92, driven gear 88 is incrementally rotated, which translates into the incremental movement of carrier guide rod 16 in a direction having a directional component normal to axis 17 as depicted by arrowed line 128, which in turn translates into a substantially vertical movement of printhead carrier 14 in one of the directions depicted by arrowed line 83, which in turn translates into an incremental vertical movement of printhead nozzle plate 33 in relation to platen 15 in print zone 40, which in turn translates to a change in the printhead-to-print medium gap when the print medium is transported between printhead(s) 32 and platen 15 during printing.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus having a printhead positioned above a print media support, wherein a print medium passes therebetween during printing, comprising:

a first side frame and a second side frame, said second side frame being spaced apart from said first side frame;

a guide rail extending between said first side frame and said second side frame;

a guide rod having a first end, a second end and an axis, said guide rod extending between said first side frame and said second side frame, said guide rod positioned to be substantially parallel to said guide rail;

a printhead carrier for carrying said printhead, said printhead carrier having a slotted portion for slideably engaging said guide rail and having a bearing for slideably engaging said guide rod;

a first eccentric bushing assembly for movably mounting said first end of said guide rod to said first side frame, and a second eccentric bushing assembly for movably mounting said second end of said guide rod to said second side frame, wherein each of said first eccentric bushing assembly and said second eccentric bushing assembly include a stationary portion and a rotatable portion;

a gap spacing adjustment mechanism coupled to at least one of said first eccentric bushing assembly and said second eccentric bushing assembly for effecting a change in position of said guide rod in a direction normal to said axis so as to adjust a gap spacing between said printhead and said print medium; and a driven gear attached to said rotatable portion of one of said first eccentric bushing assembly and said second eccentric bushing assembly, said driven gear being driven by said gap spacing adjustment mechanism, wherein said gap spacing adjustment mechanism includes a ratchet mechanism and a drive gear coupled to said ratchet mechanism, said ratchet mechanism providing selective rotation of said drive gear in a first rotational direction, said drive gear being positioned for engaging said driven gear to rotatably drive said driven gear.

2. An imaging apparatus having a printhead positioned above a print media support, wherein a print medium passes therebetween during printing, comprising:

a first side frame and a second side frame, said second side frame being spaced apart from said first side frame;

a guide rail extending between said first side frame and said second side frame;

a guide rod having a first end, a second end and an axis, said guide rod extending between said first side frame and said second side frame, said guide rod positioned to be substantially parallel to said guide rail;

a printhead carrier for carrying said printhead, said printhead carrier having a slotted portion for slideably engaging said guide rail and having a bearing for slideably engaging said guide rod;

a first eccentric bushing assembly for movably mounting said first end of said guide rod to said first side frame, and a second eccentric bushing assembly for movably mounting said second end of said guide rod to said second side frame, wherein each of said first eccentric bushing assembly and said second eccentric bushing assembly include a stationary portion and a rotatable portion;

a gap spacing adjustment mechanism coupled to at least one of said first eccentric bushing assembly and said second eccentric bushing assembly for effecting a change in position of said guide rod in a direction normal to said axis so as to adjust a gap spacing between said printhead and said print medium; and a driven gear attached to said rotatable portion of one of said first eccentric bushing assembly and said second eccentric bushing assembly, said driven gear being driven by said gap spacing adjustment mechanism, wherein said gap spacing adjustment mechanism includes a ratchet mechanism and a drive gear coupled to said ratchet mechanism, said ratchet mechanism including an actuator for effecting selective rotation of said drive gear in a first rotational direction, said drive gear being positioned for engaging said driven gear to rotatably drive said driven gear to effect a change of position of said carrier guided rod in a direction normal to said axis.

3. The imaging apparatus of claim 2, further comprising:

a motor for driving said printhead carrier in a reciprocating manner in a first direction and a second direction; and a controller for controlling the operation of said motor, wherein driving said printhead carrier in said first direction causes said printhead carrier to engage said actuator to effect a rotation of said driven gear by a first angular increment.

4. The imaging apparatus of claim 3, further comprising a home indicator pin on said driven gear and a home position sensor coupled to said controller that detects presence of said home indicator pin as said driven gear is angularly incremented.

5. The imaging apparatus of claim 3, wherein following the engagement of said printhead carrier with said actuator, said controller controls said motor to drive said printhead carrier in said second direction out of engagement with said actuator to reset said actuator to enable effecting a subsequent angular increment of rotation of said driven gear.

6. The imaging apparatus of claim 5, further comprising a print medium unit for supplying a signal representing a print medium characteristic to said controller, said controller translating said signal into a number of angular increments of rotation of said driven gear required to effect a desired gap spacing between said printhead and said print medium.

7. The imaging apparatus of claim 6, wherein said print medium unit comprises a sheet thickness sensor.

8. The imaging apparatus of claim 6, wherein said signal represents a print medium thickness assumed by said imaging device.

9. An imaging apparatus having a printhead positioned above a support for supporting a print medium during printing, comprising:

a first side frame and a second side frame, said second side frame being spaced apart from said first side frame;

a guide rail extending between said first side frame and said second side frame;

a guide rod having a first end, a second end and an axis, said guide rod extending between said first side frame and said second side frame, said guide rod positioned to be substantially parallel to said guide rail;

a printhead carrier for carrying said printhead, said printhead carrier having a slotted portion for slideably engaging said guide rail and having a bearing for slideably engaging said guide rod;

a first eccentric bushing assembly for movably mounting said first end of said guide rod to said first side frame;

a second eccentric bushing assembly for movably mounting said second end of said guide rod to said second side frame; and a gap spacing adjustment mechanism including a ratchet mechanism, a drive gear coupled to said ratchet mechanism and a driven gear coupled to said first eccentric bushing assembly, said ratchet mechanism including an actuator for effecting selective rotation of said drive gear in a first rotational direction, said drive gear being positioned for engaging said driven gear to rotatably drive said driven gear to effect a change of position of said carrier guide rod in a direction normal to said axis so as to adjust a spacing of a printhead-to-print medium gap.

10. The imaging apparatus of claim 9, further comprising:

a motor for driving said printhead carrier in a reciprocating manner in a first direction and a second direction; and a controller for controlling the operation of said motor, wherein driving said printhead carrier in said first direction causes said printhead carrier to engage said actuator to effect a rotation of said driven gear by a first angular increment.

11. The imaging apparatus of claim 10, wherein following the engagement of said printhead carrier with said actuator, said controller controls said motor to drive said printhead carrier in said second direction out of engagement with said actuator to reset said actuator to enable effecting a subsequent angular increment of rotation of said driven gear.

12. The imaging apparatus of claim 11, further comprising a print medium unit for supplying a signal representing a print medium characteristic to said controller, said controller translating said signal into a number of angular increments of rotation of said driven gear required to effect a desired gap spacing between said printhead and said print medium.

13. The imaging apparatus of claim 12, wherein said print medium unit comprises a sheet thickness sensor.

14. The imaging apparatus of claim 12, wherein said signal represents a print medium thickness assumed by said imaging device.

15. A method for adjusting a printhead-to-print medium gap in an imaging apparatus, comprising the steps of:

providing a guide rail extending between a first side frame and a second side frame;

providing a guide rod having a first end, a second end and an axis, said guide rod extending between said first side frame and said second side frame, said guide rod positioned to be substantially parallel to said guide rail;

providing a printhead carrier for carrying said printhead, said printhead carrier having a slotted portion for slideably engaging said guide rail and having a bearing for slideably engaging said guide rod;

providing a first eccentric bushing assembly for movably mounting said first end of said guide rod to said first side frame;

providing a second eccentric bushing assembly for movably mounting said second end of said guide rod to said second side frame;

providing a driven gear coupled to said first eccentric bushing;

effecting selective incremental rotation of said driven gear in a first rotational direction so as to adjust a spacing of said printhead-to-print medium gap; and driving said printhead carrier in a reciprocating manner in a first direction and a second direction, wherein driving said printhead carrier in said first direction causes said printhead carrier to engage an actuator to effect a rotation of said driven gear by a first angular increment.

16. The method of claim 15, wherein following the engagement of said printhead carrier with said actuator, further comprising the step of driving said printhead carrier in said second direction out of engagement with said actuator to reset said actuator to enable effecting a subsequent angular increment of rotation of said driven gear.

17. The method of claim 16, further comprising the steps of:

supplying a signal representing a print medium characteristic to a controller; and translating said signal into a number of angular increments of rotation of said driven gear required to effect a desired printhead-to-print medium gap.

18. The method of claim 17, further comprising the steps of:

determining a present printhead-to-print medium gap;

determining whether said present printhead-to-print medium gap requires change; and if said present printhead-to-print medium gap requires change:

determining a number of angular increments of rotation of said driven gear required to effect a desired gap between said printhead and said print medium; and driving said driven gear said number of angular increments determined by the determining step.

19. An imaging apparatus having a printhead positioned spaced apart from a print media support, wherein a print medium passes therebetween during printing, comprising:

a first side frame and a second side frame, said second side frame being spaced apart from said first side frame;

a guide rail extending between said first side frame and said second side frame;

a guide rod having a first end, a second end and an axis, said guide rod extending between said first side frame and said second side frame, said guide rod positioned to be substantially parallel to said guide rail;

a printhead carrier for carrying said printhead, said printhead carrier having a slotted portion for slideably engaging said guide rail and having a bearing for slideably engaging said guide rod;

a first assembly for movably mounting said first end of said guide rod to said first side frame;

a second assembly for movably mounting said second end of said guide rod to said second side frame;

a driven gear attached to one of said first assembly and said second assembly;

a drive gear in mating engagement with said driven gear; and a ratchet mechanism coupled to said drive gear, said ratchet mechanism providing selective rotation of said drive gear in a first rotational direction for effecting a change in position of said guide rod in a direction normal to said axis so as to adjust a gap spacing between said printhead and said print media support.

20. The imaging apparatus of claim 19, wherein said first assembly is a first eccentric bushing assembly for movably mounting said first end of said guide rod to said first side frame, and said second assembly is a second eccentric bushing assembly for movably mounting said second end of said guide rod to said second side frame, wherein each of said first eccentric bushing assembly and said second eccentric bushing assembly include a stationary portion and a rotatable portion, wherein said driven gear is attached to said rotatable portion of one of said first eccentric bushing assembly and said second eccentric bushing assembly, said driven gear being driven by said ratchet mechanism.

21. A method for adjusting a printhead-to-print medium gap in an imaging apparatus, comprising the steps of:

providing a print media support;

mounting a printhead carrier in said imaging apparatus for movement in relation to said print media support, said printhead carrier carrying a printhead;

providing an actuator for moving said printhead carrier in relation to said print media support; and driving said printhead carrier in a reciprocating manner in a first direction and a second direction, wherein driving said printhead carrier in said first direction causes said printhead carrier to engage said actuator to effect a change in a separation distance between said printhead and said print media support.

22. The method of claim 21, wherein said imaging apparatus includes a first side frame and a second side frame, the step of mounting a printhead carrier comprises the steps of:

providing a guide rail extending between said first side frame and said second side frame;

providing a guide rod having a first end, a second end and an axis, said guide rod extending between said first side frame and said second side frame, said guide rod positioned to be substantially parallel to said guide rail;

slidably mounting said a printhead carrier to said guide rail and said guide rod;

providing a first eccentric bushing assembly for movably mounting said first end of said guide rod to said first side frame; and providing a second eccentric bushing assembly for movably mounting said second end of said guide rod to said second side frame, said actuator being in driving engagement with at least one of said first eccentric bushing assembly and said second eccentric bushing assembly.

* * * * *

UNITED STATES PATENT AND TRADEMARK OFFICE

CERTIFICATE OF CORRECTION

PATENT NO. : 6,406,110 B1
DATED : June 18, 2002
INVENTOR(S) : Ahne et al.

It is certified that error appears in the above-identified patent and that said Letters Patent is hereby corrected as shown below:

Column 9,
Line 16, change "guided" to -- guide --.

Signed and Sealed this

Fourth Day of February, 2003

JAMES E. ROGAN
*Director of the United States Patent and Trademark Office*